US010090622B2

(12) United States Patent
Ludwig et al.

(10) Patent No.: US 10,090,622 B2
(45) Date of Patent: Oct. 2, 2018

(54) ELECTRICAL CONNECTOR WITH CODING FUNCTION

(71) Applicant: Delphi Technologies, Inc., Troy, MI (US)

(72) Inventors: Martin Ludwig, Wuppertal (DE); Gert Droesbeke, Erkrath (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/603,950

(22) Filed: May 24, 2017

(65) Prior Publication Data

US 2017/0352987 A1 Dec. 7, 2017

(30) Foreign Application Priority Data

Jun. 1, 2016 (EP) ..... 16172496

(51) Int. Cl.
*H01R 13/52* (2006.01)
*H01R 13/641* (2006.01)
*H01R 13/646* (2011.01)

(52) U.S. Cl.
CPC ..... *H01R 13/641* (2013.01); *H01R 13/5219* (2013.01); *H01R 13/646* (2013.01)

(58) Field of Classification Search
CPC ..... H01R 13/5219; H01R 13/5202; H01R 13/5221; H01R 13/5208; H01R 13/5205
USPC ..... 439/271, 587
See application file for complete search history.

(56) References Cited

U.S. PATENT DOCUMENTS

| | | | | |
|---|---|---|---|---|
| 5,222,909 A * | 6/1993 | Nomura | H01R 13/6582 | 439/271 |
| 5,713,761 A * | 2/1998 | Okayasu | H01R 13/4364 | 439/271 |
| 5,782,658 A * | 7/1998 | Maegawa | H01R 13/5219 | 439/271 |
| 7,371,115 B1 * | 5/2008 | Hsieh | H01R 13/5208 | 439/271 |
| 9,425,541 B2 * | 8/2016 | Data | H01R 24/28 | |

FOREIGN PATENT DOCUMENTS

| | | |
|---|---|---|
| EP | 740367 A1 | 11/1998 |
| EP | 727844 A2 | 6/2001 |
| EP | 803937 A1 | 6/2001 |
| EP | 1235306 A2 | 2/2006 |
| WO | 2015008608 A1 | 1/2015 |

* cited by examiner

*Primary Examiner* — Hien Vu
(74) *Attorney, Agent, or Firm* — Robert J. Myers

(57) ABSTRACT

The present invention relates to an electrical connector including a first connector housing with a wall arranged substantially perpendicular to the connecting axis. The wall has an opening for insertion of a second connector housing. A first collar extends from the wall concentrically around the opening. A second collar extends from the wall concentrically around the first collar. The first collar and the second collar are spaced apart. A sleeve-shaped coding element is attached with a first end to the free end of the first collar. The first collar and the sleeve-shaped coding element are arranged concentrically around the opening. A sealing element is arranged in a sealing area between the first collar and the second collar. The sleeve-shaped coding element includes a supporting feature at its first end which is suitable for holding the sealing element in its position.

12 Claims, 5 Drawing Sheets

ELECTRICAL CONNECTOR WITH CODING FUNCTION

CROSS-REFERENCE TO RELATED APPLICATION

This application claims the benefit under 35 U.S.C. § 119(a) of Patent Application No. 16172496.8 filed in the European Patent Office on Jun. 1, 2016, the entire disclosure of which is hereby incorporated by reference.

TECHNICAL FIELD OF THE INVENTION

The invention relates to a sealed electrical connector for use in high speed data transmission applications.

BACKGROUND OF THE INVENTION

With the further development of electronic driver assistance systems, the vehicles and associated technology are changing. The amount of data generated, for example, by a camera array can no longer be transmitted in real time via a conventional Controller Area Network (CAN) communication network with a transmission rate of approximately 500 kbps. One solution is the Ethernet standard, which is known from computer technology. It is viewed by vehicle manufacturers as a stable communication scheme for future vehicle networks. Since the climatic conditions in a vehicle differ substantially from those in an office environment, the connecting elements and electrical conductors must be configured to the use in a vehicle. The components need to function reliably over their entire lifecycle and need to be robust against strong temperature variations and vibration influence. Since intelligent nodes can also be located in areas exposed to increased humidity, such as in an exterior mirror, the connector connections need to be waterproof in all cases. In addition, the components must be as small as possible to keep the required volume in the vehicle low. It is understood, that the components, as is usual in the automobile industry, should be particularly low-cost in manufacture and assembly. All these requirements impose problems for developers.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

The object of the invention is to provide an electrical connector which can be used in vehicles as connecting elements in high-speed data networks. The connector should be mechanically robust and should be usable in areas with increased humidity.

In particular by an electrical connector including a first connector housing with a wall arranged substantially perpendicular to the connecting axis, the wall having an opening for insertion of a second connector housing. A first collar extends from the wall concentrically around the opening. A second collar extends from the wall concentrically around the first collar, the first collar and the second collar being spaced apart. A sleeve-shaped coding element is attached with a first end to the free end of the first collar. The first collar and the sleeve-shaped coding element are arranged concentrically around the opening. A sealing element is arranged in a sealing area between the first collar and the second collar. The sleeve-shaped coding element includes supporting feature at its first end which is suitable for holding the sealing element in its position.

The multi-part construction of the inventive connector allows configuration of a connector for a plurality of different mating connectors or hubs. The use of a coding element, selected according to the intended purpose (mating connector or hub), decides whether the connector can be mechanically connected to the mating location. The majority of the connector components are therefore the same for all applications and can be produced in large numbers, which keeps costs low. Only the coding element varies. The coding element is a relatively inexpensive injection-molded part in which the variance is not so much reflected in the cost. When the connector is assembled, first the sealing element is pushed onto the first collar and then the coding element is attached at the end of the free end of the first collar. The sealing element, which is arranged between the two collars and seals the connection location against the surroundings, when the mating connector is connected to the connector, is held in its position by the coding element. It is extremely important to hold the sealing feature in position since with incorrect sealing, moisture in the connector can lead to corrosion of the contact parts as well as to a short-circuit between the contact parts, and thus errors in the network may occur.

Advantageous embodiments of the invention can be taken from the dependent claims, the description and the figures.

According to one embodiment, a first end of the sleeve-shaped coding element and the free end of the first collar include fastening feature which is configured to hold them together. The coding element can be connected both releasably and non-releasably to the free end of the first collar. Depending on preference and use, welding, bonding and also clamping or screwing can be considered as fastening feature.

Preferably, the fastening feature include cylindrical pegs projecting perpendicularly from the inner side of the sleeve-shaped coding element and cooperating with circular-arc-shaped recesses in the free end. This structure is advantageous if a releasable connection is desired. The circular-arc-shaped recesses are dimensioned such that the pegs can snap into place and the coding element is held securely. The dimensions of the circular arc and of the peg diameter allow to set connecting as well as releasing forces.

Preferably, the first end of the sleeve-shaped coding element and the free end of the first collar can only be connected in a specific orientation. The coding element can only be connected in one orientation with the free end of the first collar so that the coding feature at the second end of the coding element is always arranged in the correct position.

Preferably, the second end of the sleeve-shaped coding element and the free end of the second collar are not in one plane, perpendicular to the connecting axis. The requirement that the coding element should not be terminated with the free end of the second collar, as is usual in conventional connectors, can result from the fact that the coding element is to be specifically protected. Then, the second collar can be made longer in connecting direction. If the collar is inadvertently pressed against an object when it is connected (e.g. blind assembly), it protects the contact element. Obviously, the coding element can also be deliberately dimensioned such that it protrudes beyond the free end of the second collar. This configuration is selected when the coding element serves as guiding element for finding the correct position for the mating connector.

Preferably, the dimensions of the sleeve-shaped coding element in connecting direction are larger than the cross-section of the sleeve-shaped coding element. A coding element which is relatively long in the connecting direction provides good guidance along the connecting path when connecting with the mating connector. The coding element slides telescopically in a guiding area of the mating connector.

According to a further embodiment, the first collar, within the sealing area, is free of joint lines and ridges on a sealing surface facing the sealing element. The sealing area needs to be free of joint lines and ridges since the sealing element placed on this surface is very sensitive to edges and could be damaged by them. In addition, a joint line or ridge can lift the sealing element off the sealing surface and adversely affect the sealing capability.

Preferably, the sealing element is made of silicone or contains silicone. Silicone has a variety of positive properties for sealing purposes, particularly in vehicles. For example, the resilience after assembly and aging.

According to a further embodiment, the sleeve-shaped coding element includes a coding feature at a second end, which is suitable, in combination with a coding feature of a mating connector, to enable or prevent the full mechanical connection of the connectors. The second end of the coding element is configured to decide whether the mating connector is accepted as correct or not.

Preferably, the coding feature is recesses at least one recess in the sleeve-shaped coding element, which extends from the second end of the sleeve-shaped coding element towards the first end. The design of the coding feature as recess is particularly easy to manufacture and functions effectively. A rectangular recess or slot extending from the end of the coding element into the material can be inserted both during injection molding of the part or later, for example, by milling. This increases flexibility in production.

Preferably, the width of the recess is small in relation to the circumference of the sleeve-shaped coding element. If the width of the recess is selected to be small in relation to the circumference of the sleeve-shaped coding element, the sleeve-shaped coding element remains stable against forces which can result from an incorrect assembly attempt.

According to a further embodiment, the at least one recess ( ) provides for the coding by its position and/or width and/or depth and/or shape. The coding feature can have all conceivable geometric shapes at the second end of the coding element. This also increases flexibility in production. However, it needs to be ensured that the mating connector has a corresponding profile.

Preferably, the cross-section of the sleeve-shaped coding element is rectangular and the at least one recess is provided in a flat area of the sleeve-shaped coding element. A rectangular form supports the positioning of the coding element on the first collar during assembly.

Preferably, the cross-section of the sleeve-shaped coding element is square. The square cross-section allows the sealing element to be constructed in a square form, which prevents an incorrect arrangement of the sealing element on the first collar during assembly.

According to another embodiment, the sleeve-shaped coding element includes a recess in each flat area, the recesses not being distributed uniformly over the circumference of the sleeve-shaped coding element. The non-uniform distribution of the recesses allows a plurality of coding possibilities while at the same time providing good guidance of the connector in the recesses when the first and second connector housings are connected.

Advantageously, the supporting feature is formed by the end surface of the first end of the coding element. The end surface forms a stop for the sealing element so that the sealing element cannot slip over the free end of the first collar.

Preferably, holding feature for holding the second connector housing is provided within the first collar. The holding feature is typically latch elements which hold the second housing in a predetermined position in the first housing.

These and other objects, which become apparent by reading the following description, are achieved by the present invention according to the subject matter of the independent claims.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
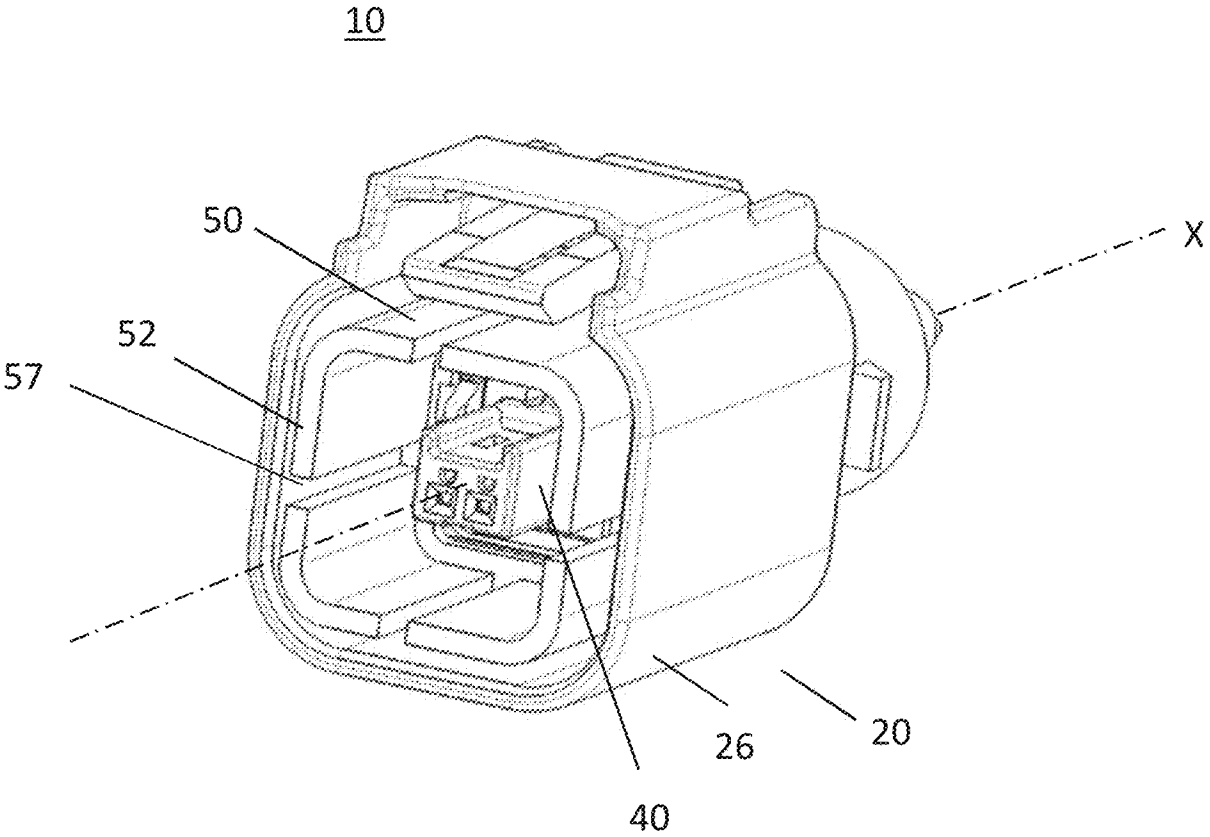
FIG. 1 shows a perspective view of the electrical connector according to one embodiment.

FIG. 1 shows a non-limiting example of a connector 10 in a perspective view. The illustration shows the area which is connected to the mating connector 110 during mating. The second collar 26 partially surrounds the coding element 50, which in turn partially surrounds the second connector housing 40. From the second end 52, slit-shaped recesses 57 extend rectilinearly along the connecting axis X into the material of the coding element 50. In this illustration, the coding element 50 has four recesses 57 distributed over its circumference. The second connector housing 40 is held centrally in the first connector housing 20. The second connector housing 40 is attached somewhat recessed in relation to the second end 52 of the coding element 50. This ensures that the coding element 50 first must find its guidance during connecting before the second connector housing 40 finds its counterpart. This structure protects the small second connector housing 40 from damage.

Figure 2:
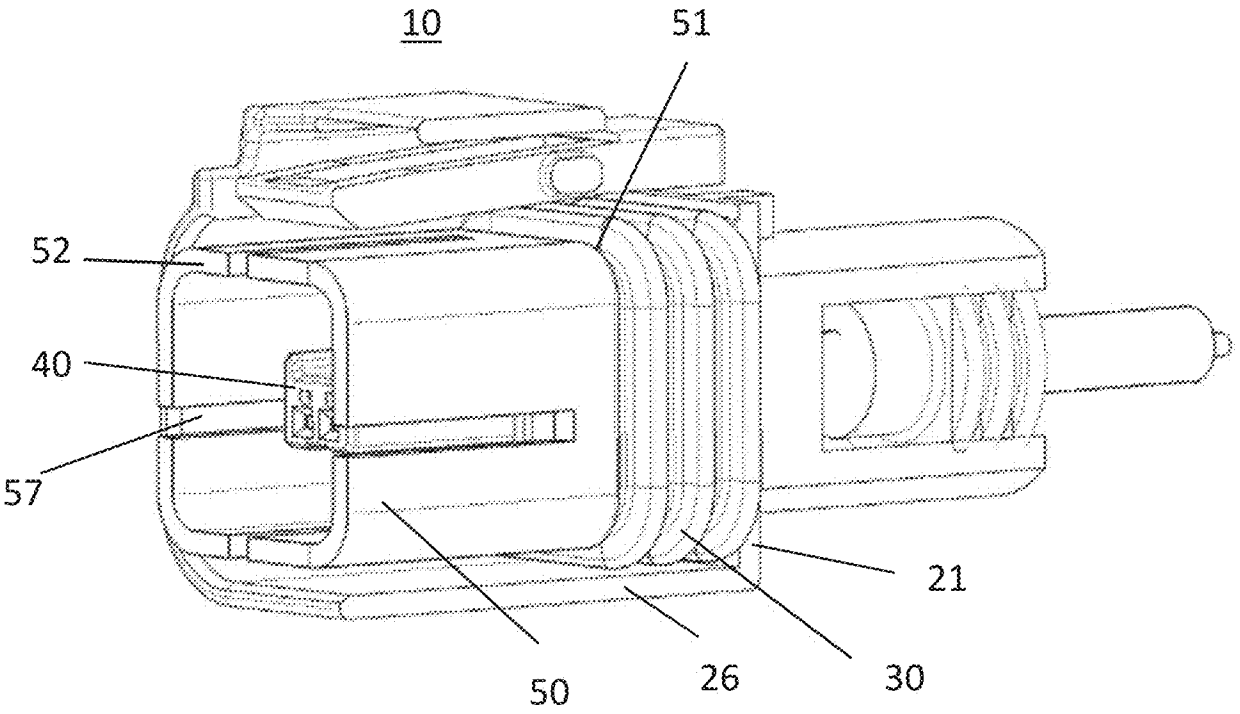
FIG. 2 shows a perspective view of the electrical connector with partially removed second collar according to one embodiment.

In FIG. 2, a portion of the second collar 26 has been removed to provide a view of the sealing element 30 and the complete coding element 50. It can be seen that the sealing element 30 cannot shift. In this illustration, the recesses 57 in the coding element 50 extend almost to the first end 51 of the coding element 50.

Figure 3:
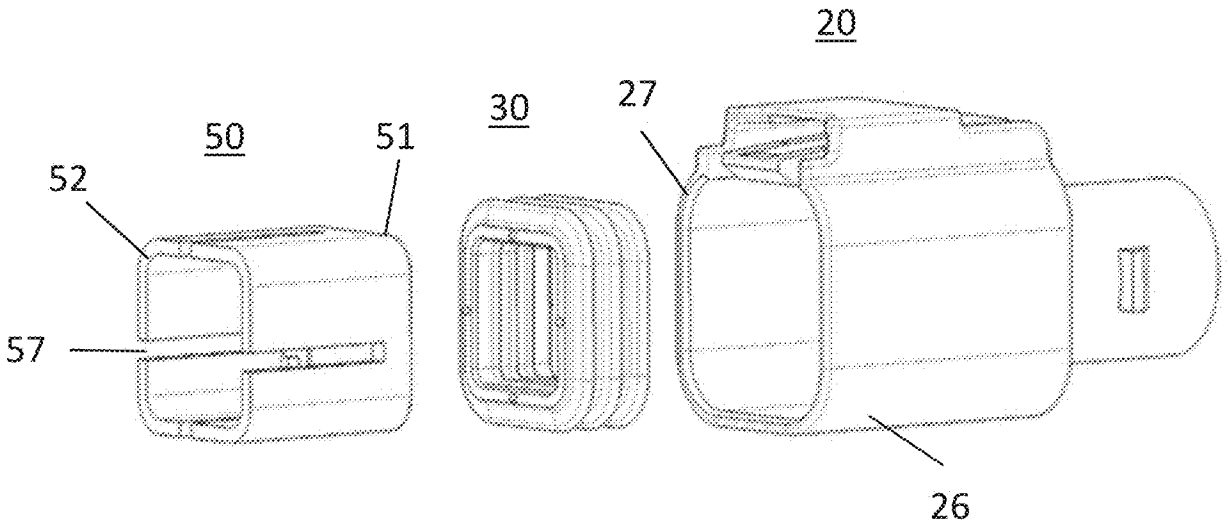
FIG. 3 shows an exploded view of the electrical connector according to one embodiment.

FIG. 3 shows the first connector housing 20, the sealing element 30 and the coding element 50 in an exploded view. In this illustration, it can be seen how the electrical connector 10 is assembled. First, the sealing element 30 is brought into the sealing area 29 (not shown herein) and then the coding element 50 is attached to the free end 25 of the first collar 23. The second connector housing 40 can be attached within the first collar 23 before or after the assembly of the sealing element 30.

Figure 5:
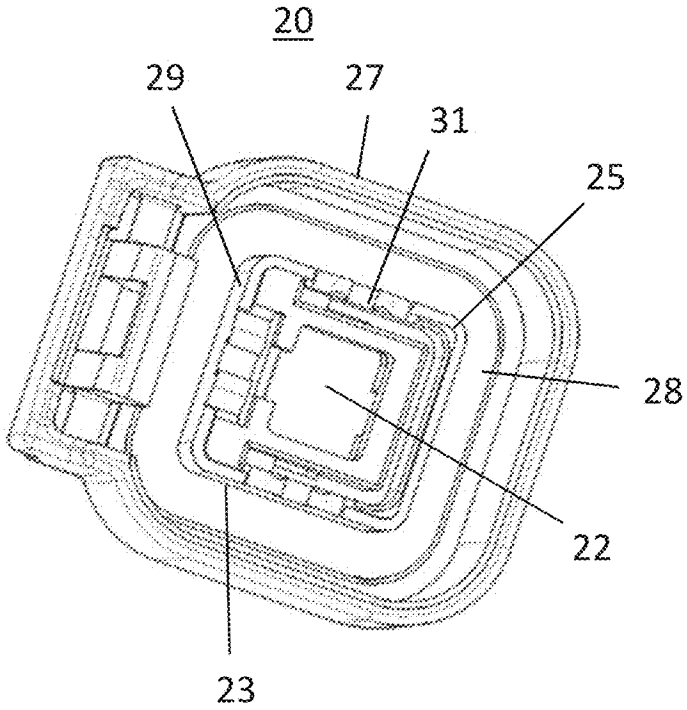
FIG. 5 shows the first connector housing in a perspective view according to one embodiment.
Figure 4:
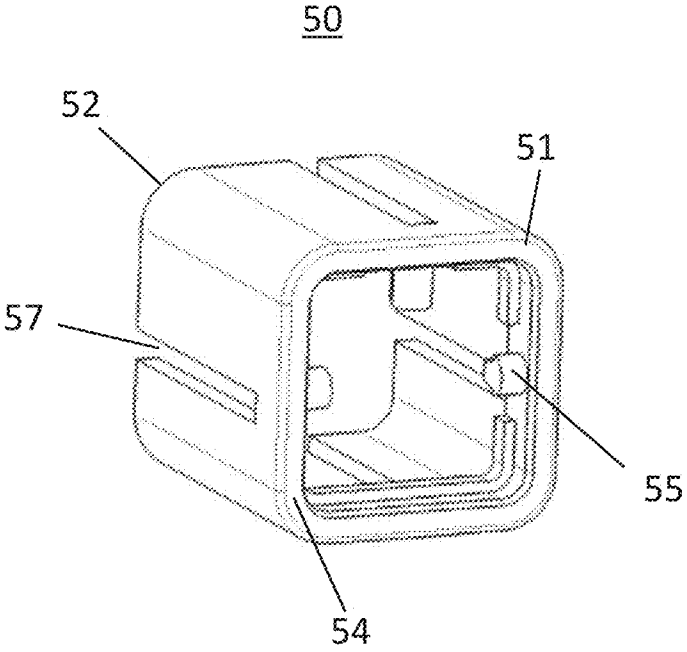
FIG. 4 shows a perspective view of the coding element, in particular of the first end according to one embodiment.
Figure 6:
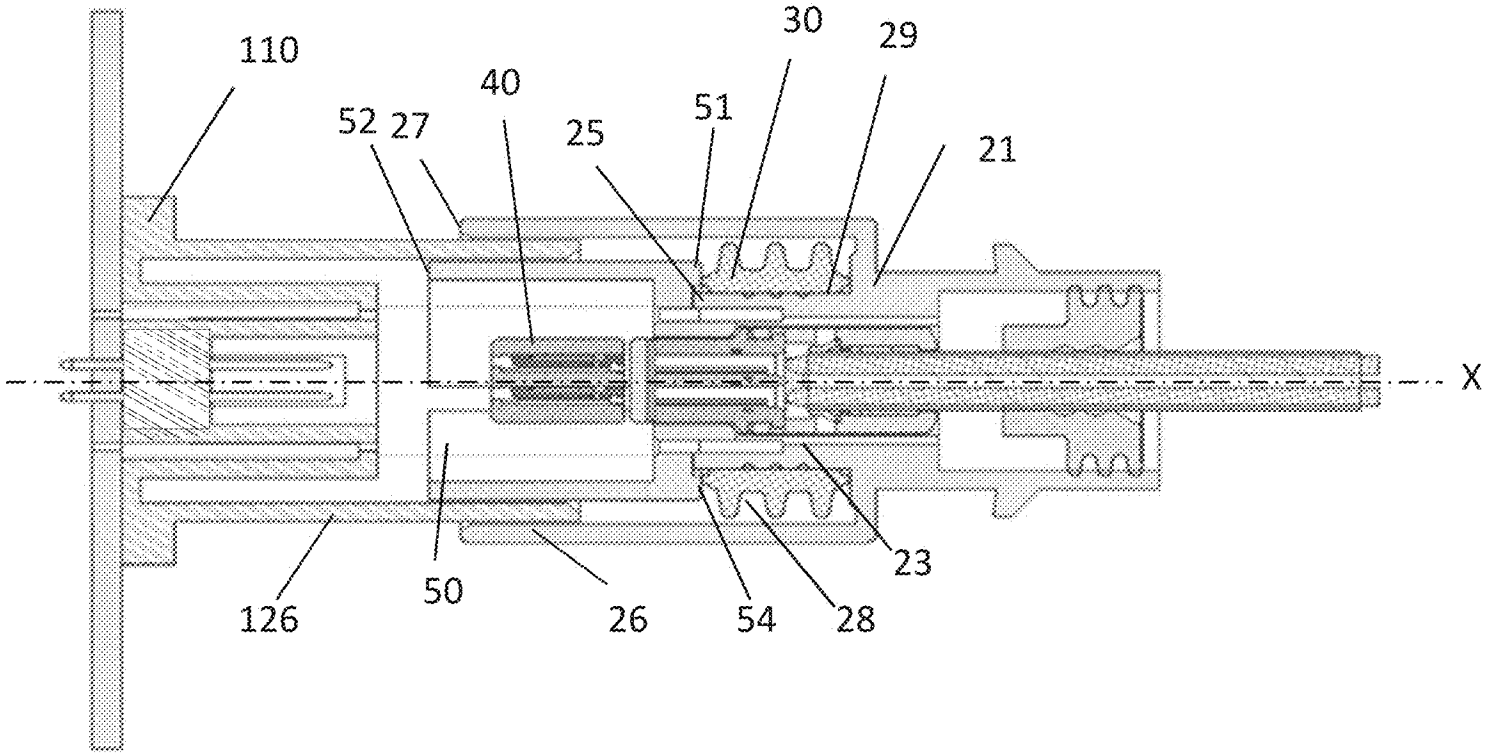
FIG. 6 shows a sectional view of the electrical connector, partially connected with a mating connector according to one embodiment.

FIG. 4 shows a perspective view of the coding element 50, in particular its first end 51. It can be seen that a circumferential end surface 54 forms the end. This end surface 54 prevents shifting of the sealing element 30 in the sealing area 28. Furthermore, pegs 55 are shown, which extend from the inner side of the coding element 50. These pegs 55, together with the recesses 31 in the first collar 23, form holding feature which hold the coding element 50 at the free end 25 of the first collar 23. By selection of the diameter of the pegs 55 and the shape and size of the recesses 31 at the free end 25 of the first collar 23, the force required for connecting and releasing can be set. As can be seen in FIG. 5, a sealing area 28, which is open in the connecting direction X, is defined by the first collar 23, the second collar 26 and the wall 21. When connecting with a mating connector 110, a counter collar 126 slides into the sealing area 28 and is sealed by the sealing element 30, as shown in FIG. 6.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connector, comprising:

a first connector housing; and a second connector housing, wherein the first connector housing defines a wall arranged substantially perpendicular to a connecting axis, wherein the wall defines an opening for insertion of the second connector housing, wherein the first connector housing includes a first collar that extends from the wall concentrically around the opening and a second collar that concentrically extends from the wall around the first collar, wherein the first collar and the second collar are spaced apart, wherein a sleeve-shaped coding element is attached with a first end to a free end of the first collar, wherein the first collar and the sleeve-shaped coding element are concentrically arranged around the opening, wherein a sealing element is arranged in a sealing area between the first collar and the second collar, wherein the sleeve-shaped coding element includes a supporting feature at the first end, wherein a dimension of the sleeve-shaped coding element in the connecting direction is larger than a cross-section of the sleeve-shaped coding element, wherein the sleeve-shaped coding element includes a coding feature at a second end, which is suitable, in combination with a corresponding coding feature of a mating connector, to enable or prevent full mechanical connection of the first and second connector housings, and wherein the coding feature is a recess in the sleeve-shaped coding element, which extends from the second end of the sleeve-shaped coding element along the connecting axis in a direction of the first end.

2. The electrical connector as claimed in claim 1, wherein a width of the recess is small in relation to a circumference of the sleeve-shaped coding element.

3. The electrical connector as claimed in claim 2, wherein the cross-section of the sleeve-shaped coding element is rectangular and the recess is provided in a flat area of the sleeve-shaped coding element.

4. The electrical connector as claimed in claim 3, wherein the sleeve-shaped coding element includes a plurality of the recess in each flat area, the plurality of the recess not being distributed uniformly over the circumference of the sleeve-shaped coding element.

5. The electrical connector as claimed in claim 1, wherein the supporting feature is formed by an end surface of the first end of the sleeve-shaped coding element.

6. The electrical connector as claimed in claim 1, wherein a first end of the sleeve-shaped coding element and the free end of the first collar include fastening feature which is configured to hold the first end of the sleeve-shaped coding element and the free end of the first collar together.

7. The electrical connector as claimed in claim 6, wherein the fastening feature include cylindrical pegs projecting perpendicularly from an inner side of the sleeve-shaped coding element and cooperating with circular-arc-shaped recesses in the free end.

8. The electrical connector as claimed in claim 1, wherein the first end of the sleeve-shaped coding element and the free end of the first collar can only be connected in a specific orientation.

9. The electrical connector as claimed in claim 1, wherein a second end of the sleeve-shaped coding element and a free end of the second collar are not in one plane, perpendicular to the connecting axis.

10. The electrical connector as claimed in claim 1, wherein the first collar, within the sealing area, is free of joint lines and ridges on a sealing surface facing the sealing element.

11. The electrical connector as claimed in claim 1, wherein the sealing element is made of silicone or contains silicone.

12. The electrical connector as claimed in claim 1, wherein the cross-section of the sleeve-shaped coding element is square-shaped.

* * * * *